US005918964A

United States Patent [19]

Bou

[11] Patent Number: 5,918,964

[45] Date of Patent: Jul. 6, 1999

[54] PUMPKIN ILLUMINATION DEVICE

[76] Inventor: Anna Rosa Bou, 147 Maspeth Ave., Brooklyn, N.Y. 11211

[21] Appl. No.: 09/074,164

[22] Filed: May 7, 1998

[51] Int. Cl.[6] ..... F21V 33/00

[52] U.S. Cl. ..... 362/186; 362/154; 362/122; 362/808

[58] Field of Search ..... 362/186, 154, 362/122, 190, 191, 806, 808, 124

[56] References Cited

U.S. PATENT DOCUMENTS

| | | | |
|---|---|---|---|
| 4,698,732 | 10/1987 | Hickey | 362/154 |
| 4,802,071 | 1/1989 | Schuster | 362/154 |
| 5,597,230 | 1/1997 | Newman | 362/808 |

*Primary Examiner*—Thomas M. Sember

[57] ABSTRACT

A new pumpkin illumination device for providing light for a Halloween pumpkin while reducing risk of fire. The inventive device includes a base member is provided having a generally cylindrical configuration. The base member has an externally threaded open upper end, a closed lower end and a cylindrical side wall therebetween. The base member has a battery chamber interiorly thereof. The battery chamber has a spring disposed therein. The open upper end has an end cap removably coupled thereto. The end cap has an aperture through a central portion thereof for receiving a lower end of a light bulb therethrough whereby the lower end of the light bulb is in operative communication with the battery chamber. A support bracket couples with the base member. The support bracket is positionable within a pumpkin.

5 Claims, 2 Drawing Sheets

PUMPKIN ILLUMINATION DEVICE

BACKGROUND OF THE INVENTION

1. Field of the Invention

The present invention relates to portable lights and more particularly pertains to a new pumpkin illumination device for providing light for a Halloween pumpkin while reducing risk of fire.

2. Description of the Prior Art

The use of portable lights is known in the prior art. More specifically, portable lights heretofore devised and utilized are known to consist basically of familiar, expected and obvious structural configurations, notwithstanding the myriad of designs encompassed by the crowded prior art which have been developed for the fulfillment of countless objectives and requirements.

Known prior art portable lights include U.S. Pat. No. 5,091,833 to Paniaguas et al.; U.S. Pat. No. Des. 303,158 to Charet et al.; U.S. Pat. No. Des. 298,060 to Johannsen; U.S. Pat. No. 3,965,574 to Graves; U.S. Pat. No. 4,926,296 to Blume et al.; and U.S. Pat. No. Des. 281,819 to Schosser et al.

While these devices fulfill their respective, particular objectives and requirements, the aforementioned patents do not disclose a new pumpkin illumination device. The inventive device includes a base member is provided having a generally cylindrical configuration. The base member has an externally threaded open upper end, a closed lower end and a cylindrical side wall therebetween. The base member has a battery chamber interiorly thereof. The battery chamber has a spring disposed therein. The open upper end has an end cap removably coupled thereto. The end cap has an aperture through a central portion thereof for receiving a lower end of a light bulb therethrough whereby the lower end of the light bulb is in operative communication with the battery chamber. A support bracket couples with the base member. The support bracket is positionable within a pumpkin.

In these respects, the pumpkin illumination device according to the present invention substantially departs from the conventional concepts and designs of the prior art, and in so doing provides an apparatus primarily developed for the purpose of providing light for a Halloween pumpkin while reducing risk of fire.

SUMMARY OF THE INVENTION

In view of the foregoing disadvantages inherent in the known types of portable lights now present in the prior art, the present invention provides a new pumpkin illumination device construction wherein the same can be utilized for providing light for a Halloween pumpkin while reducing risk of fire.

The general purpose of the present invention, which will be described subsequently in greater detail, is to provide a new pumpkin illumination device apparatus and method which has many of the advantages of the portable lights mentioned heretofore and many novel features that result in a new pumpkin illumination device which is not anticipated, rendered obvious, suggested, or even implied by any of the prior art portable lights, either alone or in any combination thereof.

To attain this, the present invention generally comprises a pumpkin having a hole formed through an upper end thereof thereby exposing a hollow interior. The pumpkin has cut outs in a front face thereof. A base member is provided having a generally cylindrical configuration. The base member has an externally threaded open upper end, a closed lower end and a cylindrical side wall therebetween. The base member has a battery chamber interiorly thereof. The battery chamber has a spring disposed therein. The open upper end has an end cap removably coupled thereto. The end cap has an aperture through a central portion thereof for receiving a lower end of a light bulb therethrough whereby the lower end of the light bulb is in operative communication with the battery chamber. A support bracket couples with the base member. The support bracket includes an upper circular ring for receiving the base member therein. The circular ring has a pair of diametrically opposed flexible tabs extending downwardly in an angular orientation therefrom. Each of the flexible tabs have a flexible foot disposed on free ends thereof. The support bracket is positionable within the pumpkin.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pumpkin illumination device apparatus and method which has many of the advantages of the portable lights mentioned heretofore and many novel features that result in a new pumpkin illumination device which is not anticipated, rendered obvious, suggested, or even implied by any of the prior art portable lights, either alone or in any combination thereof.

It is another object of the present invention to provide a new pumpkin illumination device which may be easily and efficiently manufactured and marketed.

It is a further object of the present invention to provide a new pumpkin illumination device which is of a durable and reliable construction.

An even further object of the present invention is to provide a new pumpkin illumination device which is susceptible of a low cost of manufacture with regard to both materials and labor, and which accordingly is then susceptible of low prices of sale to the consuming public, thereby making such pumpkin illumination device economically available to the buying public.

Still yet another object of the present invention is to provide a new pumpkin illumination device which provides in the apparatuses and methods of the prior art some of the advantages thereof, while simultaneously overcoming some of the disadvantages normally associated therewith.

Still another object of the present invention is to provide a new pumpkin illumination device for providing light for a Halloween pumpkin while reducing risk of fire.

Yet another object of the present invention is to provide a new pumpkin illumination device which includes a base member is provided having a generally cylindrical configuration. The base member has an externally threaded open upper end, a closed lower end and a cylindrical side wall therebetween. The base member has a battery chamber interiorly thereof. The battery chamber has a spring disposed therein. The open upper end has an end cap removably coupled thereto. The end cap has an aperture through a central portion thereof for receiving a lower end of a light bulb therethrough whereby the lower end of the light bulb is in operative communication with the battery chamber. A support bracket couples with the base member. The support bracket is positionable within a pumpkin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
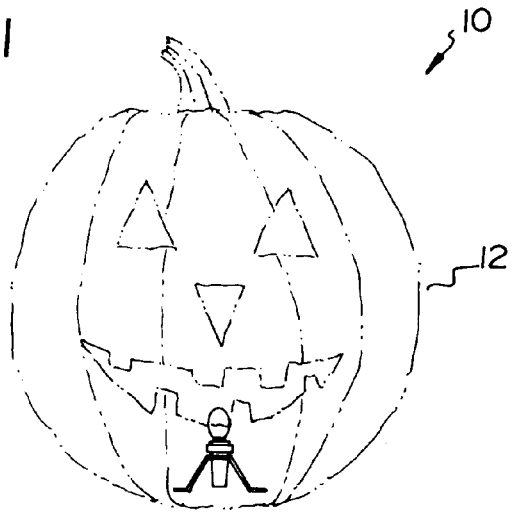
FIG. 1 is a front view of a new pumpkin illumination device according to the present invention illustrated within a pumpkin.
Figure 2:
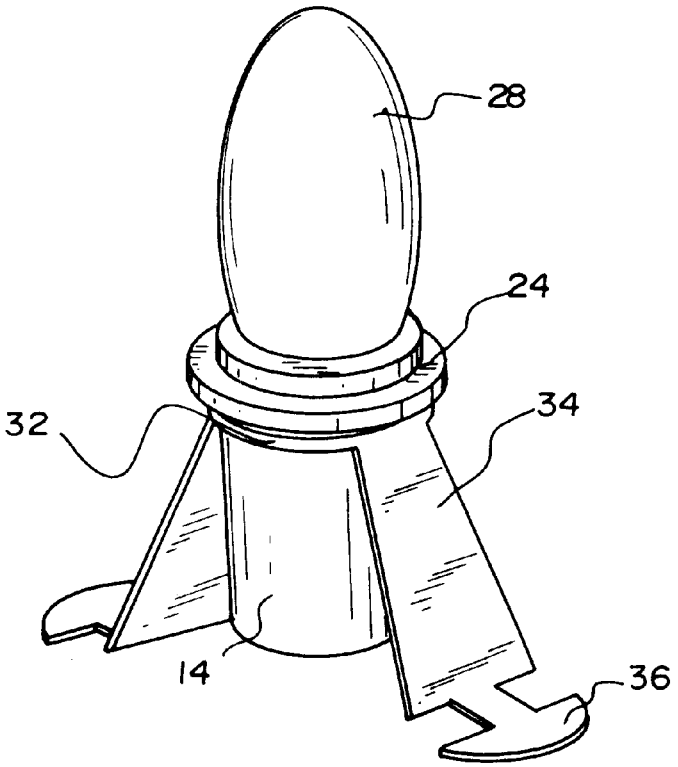
FIG. 2 is a perspective view of the present invention.
Figure 3:
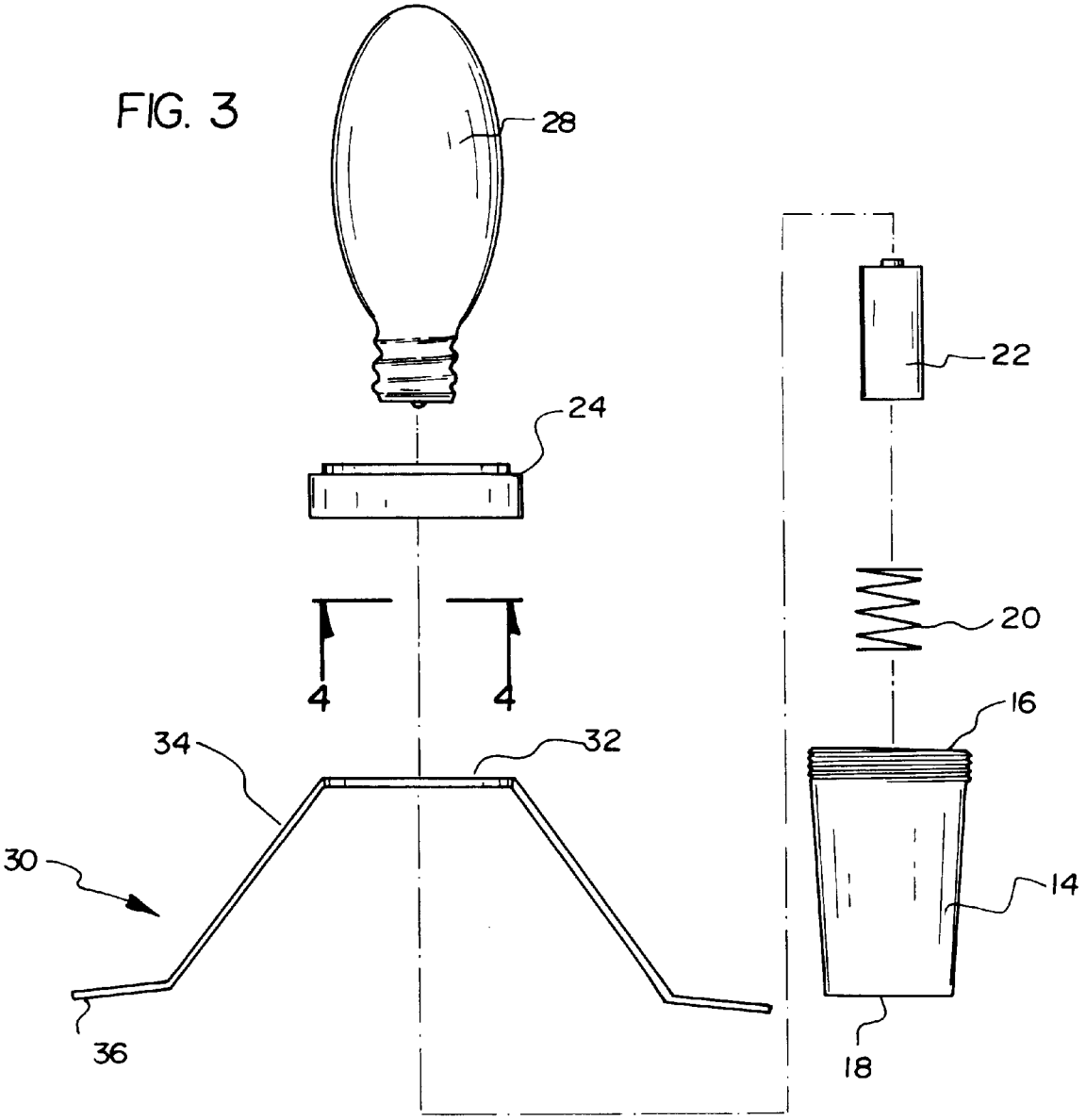
FIG. 3 is an exploded front view of the present invention.
Figure 4:
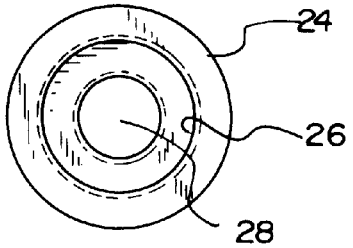
FIG. 4 is a bottom plan view of the present invention as taken along line 4—4 of FIG. 3.

With reference now to the drawings, and in particular to FIGS. 1 through 4 thereof, a new pumpkin illumination device embodying the principles and concepts of the present invention and generally designated by the reference numeral 10 will be described.

As best illustrated in FIGS. 1 through 4, the pumpkin illumination device 10 comprises a pumpkin 12 having a hole formed through an upper end thereof thereby exposing a hollow interior. The pumpkin 12 has cut outs in a front face thereof. Note FIG. 1.

A base member 14 is provided having a generally cylindrical configuration. The base member 14 has an externally threaded open upper end 16, a closed lower end 18 and a cylindrical side wall therebetween. The base member 14 has a battery chamber interiorly thereof. The battery chamber has a spring 20 disposed therein. The battery chamber is dimensioned for receiving a battery 22 therein. The open upper end 16 has an end cap 24 removably coupled thereto. The end cap 24 has an aperture 26 through a central portion thereof for receiving a lower end of a light bulb 28 therethrough whereby the lower end of the light bulb 28 is in operative communication with the battery chamber.

A support bracket 30 couples with the base member 14. The support bracket 30 includes an upper circular ring 32 for receiving the base member 14 therein. The base member 14 slides within the circular ring 32. The end cap 24 is wider than the circular ring 32 thereby allowing for the support bracket 30 to elevate the base member 14. The circular ring 32 has a pair of diametrically opposed flexible tabs 34 extending downwardly in an angular orientation therefrom. Each of the flexible tabs 34 have a flexible foot 36 disposed on free ends thereof. The support bracket 30 is positionable within the pumpkin 12. Each flexible foot 36 could be manipulated to penetrate the pumpkin 12 to further support the light.

In use, the present invention is an alternative means to illuminate a Halloween pumpkin. The present invention would provide individuals with added safety by possibly reducing the incidence of fires which originate from candles burning within jack o'lanterns. The present invention would be positioned within the interior of the pumpkin after it had been carved and the pulp and seeds were removed. The support bracket 30 would ensure the light remained in place within the interior of the pumpkin 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new pumpkin illumination device for providing light for a Halloween pumpkin while reducing risk of fire comprising, in combination:

a pumpkin having a hole formed through an upper end thereof thereby exposing a hollow interior, the pumpkin having cut outs in a front face thereof;

a base member having a generally cylindrical configuration, the base member having an externally threaded open upper end, a closed lower end and a cylindrical side wall therebetween, the base member having a battery chamber interiorly thereof, the battery chamber having a spring disposed therein, the open upper end having an end cap removably coupled thereto, the end cap having an aperture through a central portion thereof for receiving a lower end of a light bulb therethrough whereby the lower end of the light bulb being in operative communication with the battery chamber;

a support bracket coupling with the base member, the support bracket including an upper circular ring for receiving the base member therein, the circular ring having a pair of diametrically opposed flexible tabs extending downwardly in an angular orientation therefrom, each of the flexible tabs having a flexible foot disposed on free ends thereof, the support bracket being positionable within the pumpkin.

2. A new pumpkin illumination device for providing light for a Halloween pumpkin while reducing risk of fire comprising, in combination:

a base member having a generally cylindrical configuration, the base member having an externally threaded open upper end, a closed lower end and a cylindrical side wall therebetween, the base member having a battery chamber interiorly thereof, the battery chamber having a spring disposed therein, the open upper end having an end cap removably coupled thereto, the end cap having an aperture through a central portion thereof for receiving a lower end of a light bulb therethrough whereby the lower end of the light bulb being in operative communication with the battery chamber;

a support bracket coupling with the base member, the support bracket being positionable within a pumpkin.

3. The pumpkin illumination device as set forth in claim 2 wherein the support bracket includes an upper circular ring for receiving the base member therein.

4. The pumpkin illumination device as set forth in claim 3 wherein the circular ring has a pair of diametrically opposed flexible tabs extending downwardly in an angular orientation therefrom.

5. The pumpkin illumination device as set forth in claim 4 wherein each of the flexible tabs have a flexible foot disposed on free ends thereof.

* * * * *